US009528464B2

(12) United States Patent
Beyer et al.

(10) Patent No.: US 9,528,464 B2
(45) Date of Patent: Dec. 27, 2016

(54) BORE BRIDGE COOLING PASSAGE

(71) Applicant: Ford Global Technologies, LLC, Dearborn, MI (US)

(72) Inventors: Theodore Beyer, Canton, MI (US); Antony George Schepak, Howell, MI (US); Mathew Leonard Hintzen, Stockbridge, MI (US); Jody Michael Slike, Farmington Hills, MI (US); Venkat Nara, Northville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 208 days.

(21) Appl. No.: 14/456,033

(22) Filed: Aug. 11, 2014

(65) Prior Publication Data

US 2016/0040621 A1 Feb. 11, 2016

(51) Int. Cl.
*F02F 3/00* (2006.01)
*F02F 1/10* (2006.01)
(Continued)

(52) U.S. Cl.
CPC ..... *F02F 1/10* (2013.01); *B22C 9/106* (2013.01); *B22D 17/00* (2013.01); *B22D 17/24* (2013.01);
(Continued)

(58) Field of Classification Search
CPC ..... F02B 2075/025; F02B 3/06; F02F 3/00; F05C 2201/021; F05C 2201/0448
(Continued)

(56) References Cited

U.S. PATENT DOCUMENTS 4,059,143 A * 11/1977 Morita ..... B22D 17/30 164/113
4,693,294 A 9/1987 Albrecht et al.
(Continued)

FOREIGN PATENT DOCUMENTS

DE 102006053179 A1 5/2007
DE 102012021065 A1 8/2013
(Continued)

OTHER PUBLICATIONS

Heppes, Frank, "Stable Filled Aluminum Tubes for Foundries—Near End Outline Casting With Remarkable Material Savings", Drahtzug Stein combicore, 27 pages.
(Continued)

*Primary Examiner* — Lindsay Low
*Assistant Examiner* — Charles Brauch
(74) *Attorney, Agent, or Firm* — Brooks Kushman P.C.; Damian Porcari

(57) ABSTRACT

A tool and a method of using the tool are provided for forming an engine component. The engine has a block defining a first cylinder and a second cylinder spaced apart by a bore bridge. The bore bridge defines a first cooling passage spaced apart from a deck face and extending transversely, and a second cooling passage positioned between the first passage and the deck face and extending transversely. The first and second passages are formed by a casting skin. In forming the engine component, a die is provided that defines a locator recess and at least one core. An insert is positioned into the recess on the die. The insert has a cast shell surrounding a lost core. The component is die cast with the die and the insert to form a cooling jacket. The insert is adapted to form the cooling passages for the bore bridge.

17 Claims, 5 Drawing Sheets

(51) Int. Cl.

| | |
|---|---|
| ***B22D 17/00*** | (2006.01) |
| ***B22D 17/24*** | (2006.01) |
| ***B22D 19/00*** | (2006.01) |
| ***F02F 1/14*** | (2006.01) |
| ***F02F 1/16*** | (2006.01) |
| ***B22C 9/10*** | (2006.01) |
| *F02B 3/06* | (2006.01) |
| *F02B 75/02* | (2006.01) |

(52) U.S. Cl.
CPC ..... *B22D 19/0009* (2013.01); *B22D 19/0072* (2013.01); *F02F 1/14* (2013.01); *F02F 1/16* (2013.01); *F02B 3/06* (2013.01); *F02B 2075/025* (2013.01); *F02F 3/00* (2013.01); *F05C 2201/021* (2013.01); *F05C 2201/0448* (2013.01)

(58) Field of Classification Search
USPC ..... 123/193.1
See application file for complete search history.

(56) References Cited

U.S. PATENT DOCUMENTS

| | | | | |
|---|---|---|---|---|
| 6,205,959 | B1 | 3/2001 | Smetan et al. | |
| 6,479,165 | B2 | 11/2002 | Fischer et al. | |
| 6,575,124 | B2 * | 6/2003 | Shimizu | F02F 1/108 123/193.2 |
| 6,769,474 | B2 | 8/2004 | Engels et al. | |
| 2002/0078850 | A1 * | 6/2002 | Renfro | F42B 1/028 102/476 |
| 2006/0048911 | A1 * | 3/2006 | Newcomb | B22D 19/0009 164/98 |
| 2006/0124082 | A1 | 6/2006 | Grunenberg et al. | |
| 2009/0013982 | A1 * | 1/2009 | Yuasa | F02B 25/14 123/65 R |
| 2011/0068619 | A1 * | 3/2011 | Werner | B22D 19/00 301/127 |
| 2013/0199749 | A1 * | 8/2013 | Moschini | B22C 9/10 164/529 |

FOREIGN PATENT DOCUMENTS

| | | | |
|---|---|---|---|
| EP | 1253310 | A2 | 10/2002 |
| GB | 2132266 | A | 7/1984 |

OTHER PUBLICATIONS

Pierri, Dario, "Lost Core—New Perspectives in Die Casting", Buhler, 2012, 20 pages.

Dodiuk, Hanna and Goodman, Sydney H., "Phenolic Resins in Foundry and Shell Molding Applications", Handbook of Thermoset Plastics, Nov. 28, 2013, p. 30.

* cited by examiner

BORE BRIDGE COOLING PASSAGE

TECHNICAL FIELD

Various embodiments relate to a system and a method of forming a cooling passage in a bore bridge of an internal combustion engine.

BACKGROUND

During engine operation, an engine block and cylinder head may require cooling, and a water jacket system with a water-cooled engine design may be provided. The bore bridge on the cylinder block and/or the cylinder head is a stressed area with little packaging space. The bore bridge region heats during engine operation based on the small dimensions of the bridge and the position of the bridge between adjacent cylinders.

SUMMARY

According to an embodiment, a tool is provided for forming an engine block. A die has a support member defining first and second locator recesses positioned between first and second cores adapted to form a cylinder cooling jacket. An insert has a lost core generally encapsulated by a cast shell. The insert has first and second locator protrusions sized to be received by the first and second locator recesses respectively. The insert is adapted to form a cooling passage for a bore bridge of the engine block between adjacent cylinders.

According to another embodiment, a method of forming an engine component is provided. A die is provided that defines a locator recess and at least one core. An insert is positioned into the recess on the die. The insert has a cast shell surrounding a lost core. The component is die cast with the die and the insert to form a cooling jacket with a casting skin about the insert for a bore bridge cooling passage.

According to yet another embodiment, an engine is provided with a block defining a first cylinder and a second cylinder spaced apart along a longitudinal axis of the engine by a bore bridge. The bore bridge defines a first passage spaced apart from a deck face and extending transversely, and a second passage positioned between the first passage and the deck face and extending transversely. The first and second passages are formed by a casting skin.

Various embodiments of the present disclosure have associated, non-limiting advantages. For example, die cast blocks with narrow bridges may be difficult to cool, and/or the liner and gasket joint may be insufficiently cooled, especially for small bore, high output engines, such as aluminum block engines. The engine block is die cast using a lost core that is loaded into a die slide. When the die slide and the lost core are removed, bore bridge cooling passage (s) are provided in the bore bridge. These passages may be formed in a variety of cross-sectional geometries based on the cooling requirements.

DETAILED DESCRIPTION

As required, detailed embodiments of the present disclosure are provided herein; however, it is to be understood that the disclosed embodiments are merely examples that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
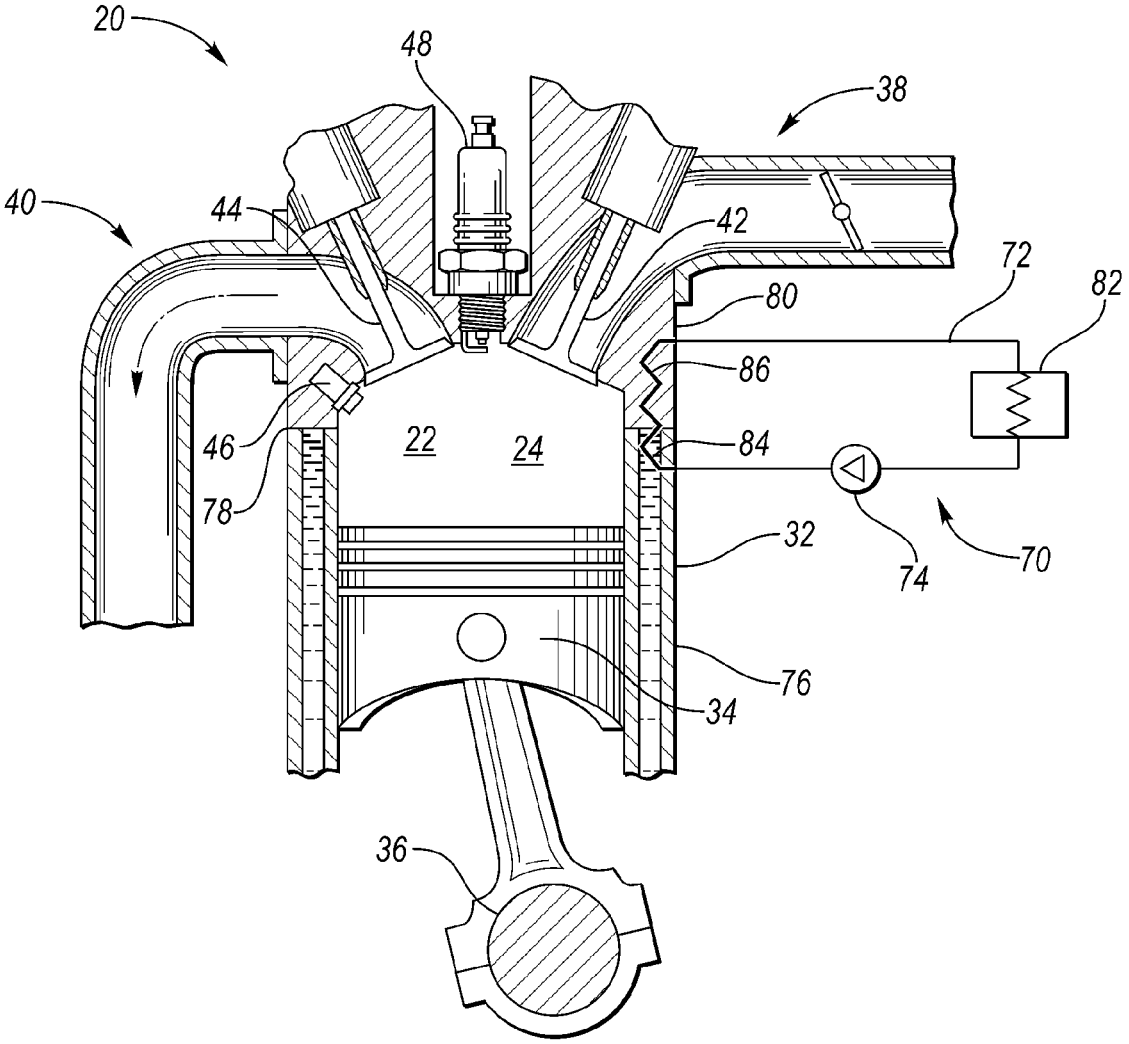
FIG. 1 illustrates a schematic of an engine configured to implement the disclosed embodiments.

FIG. 1 illustrates a schematic of an internal combustion engine 20. The engine 20 has a plurality of cylinders 22, and one cylinder is illustrated. In one example, the engine 20 is an in-line four cylinder engine, and, in other examples, has other arrangements and numbers of cylinders. The engine 20 block and cylinder head may be cast from aluminum, an aluminum alloy, or another metal. The engine 20 has a combustion chamber 24 associated with each cylinder 22. The cylinder 22 is formed by cylinder walls 32 and piston 34. The piston 34 is connected to a crankshaft 36. The combustion chamber 24 is in fluid communication with the intake manifold 38 and the exhaust manifold 40. An intake valve 42 controls flow from the intake manifold 38 into the combustion chamber 24. An exhaust valve 44 controls flow from the combustion chamber 30 to the exhaust manifold 40. The intake and exhaust valves 42, 44 may be operated in various ways as is known in the art to control the engine operation.

A fuel injector 46 delivers fuel from a fuel system directly into the combustion chamber 30 such that the engine is a direct injection engine. A low pressure or high pressure fuel injection system may be used with the engine 20, or a port injection system may be used in other examples. An ignition system includes a spark plug 48 that is controlled to provide energy in the form of a spark to ignite a fuel air mixture in the combustion chamber 24. In other embodiments, other fuel delivery systems and ignition systems or techniques may be used, including compression ignition.

The engine 20 includes a controller and various sensors configured to provide signals to the controller for use in controlling the air and fuel delivery to the engine, the ignition timing, the power and torque output from the engine, and the like. Engine sensors may include, but are not limited to, an oxygen sensor in the exhaust manifold 40, an engine coolant temperature, an accelerator pedal position sensor, an engine manifold pressure (MAP sensor, an engine position sensor for crankshaft position, an air mass sensor in the intake manifold 38, a throttle position sensor, and the like.

In some embodiments, the engine 20 is used as the sole prime mover in a vehicle, such as a conventional vehicle, or a stop-start vehicle. In other embodiments, the engine may be used in a hybrid vehicle where an additional prime mover, such as an electric machine, is available to provide additional power to propel the vehicle.

Each cylinder 22 may operate under a four-stroke cycle including an intake stroke, a compression stroke, an ignition stroke, and an exhaust stroke. In other embodiments, the engine may operate with a two stroke cycle. During the intake stroke, the intake valve 42 opens and the exhaust valve 44 closes while the piston 34 moves from the top of the cylinder 22 to the bottom of the cylinder 22 to introduce air from the intake manifold to the combustion chamber. The piston 34 position at the top of the cylinder 22 is generally known as top dead center (TDC). The piston 34 position at the bottom of the cylinder is generally known as bottom dead center (BDC).

During the compression stroke, the intake and exhaust valves 42, 44 are closed. The piston 34 moves from the bottom towards the top of the cylinder 22 to compress the air within the combustion chamber 24.

Fuel is then introduced into the combustion chamber 24 and ignited. In the engine 20 shown, the fuel is injected into the chamber 24 and is then ignited using spark plug 48. In other examples, the fuel may be ignited using compression ignition.

During the expansion stroke, the ignited fuel air mixture in the combustion chamber 24 expands, thereby causing the piston 34 to move from the top of the cylinder 22 to the bottom of the cylinder 22. The movement of the piston 34 causes a corresponding movement in crankshaft 36 and provides for a mechanical torque output from the engine 20.

During the exhaust stroke, the intake valve 42 remains closed, and the exhaust valve 44 opens. The piston 34 moves from the bottom of the cylinder to the top of the cylinder 22 to remove the exhaust gases and combustion products from the combustion chamber 24 by reducing the volume of the chamber 24. The exhaust gases flow from the combustion cylinder 22 to the exhaust manifold 40 and to an aftertreatment system such as a catalytic converter.

The intake and exhaust valve 42, 44 positions and timing, as well as the fuel injection timing and ignition timing may be varied for the various engine strokes.

The engine 20 includes a cooling system 70 to remove heat from the engine 20. The amount of heat removed from the engine 20 may be controlled by a cooling system controller or the engine controller. The cooling system 70 may be integrated into the engine 20 as a cooling jacket. The cooling system 70 has one or more cooling circuits 72 that may contain water or another coolant as the working fluid. The cooling system 70 has one or more pumps 74 that provide fluid in the circuit 72 to cooling passages in the cylinder block 76 and cylinder head 80. Coolant may flow from the cylinder block 76 to the cylinder head 80, or vice versa. The cooling system 70 may also include valves (not shown) to control to flow or pressure of coolant, or direct coolant within the system 70.

The cooling passages in the cylinder block 76 may be adjacent to one or more of the combustion chambers 24 and cylinders 22, and the bore bridges formed between the cylinders 22. Similarly, the cooling passages in the cylinder head 80 may be adjacent to one or more of the combustion chambers 24 and cylinders 22, and the bore bridges formed between the combustion chambers 24.

The cylinder head 80 is connected to the cylinder block 76 to form the cylinders 22 and combustion chambers 24. A head gasket 78 in interposed between the cylinder block 76 and the cylinder head 80 to seal the cylinders 22. The gasket 78 may also have a slot, apertures, or the like to fluidly connect the jackets 84, 86. Coolant flows from the cylinder head 80 and out of the engine 20 to a radiator 82 or other heat exchanger where heat is transferred from the coolant to the environment.

Figure 2:
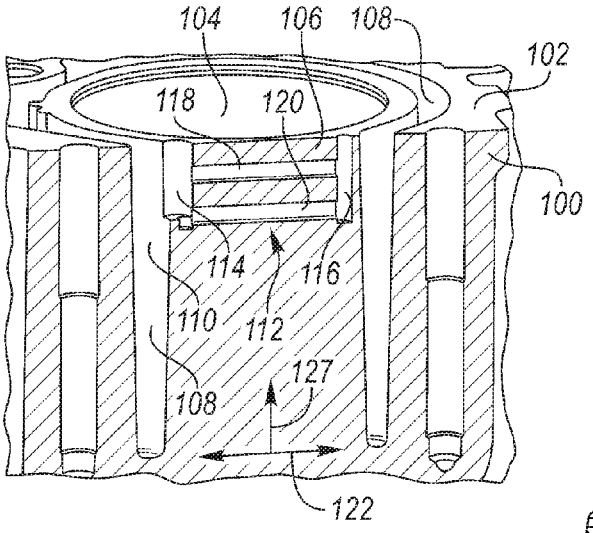
FIG. 2 illustrates a partial sectional view of an engine block taken across a bore bridge according to an embodiment.
Figure 3:
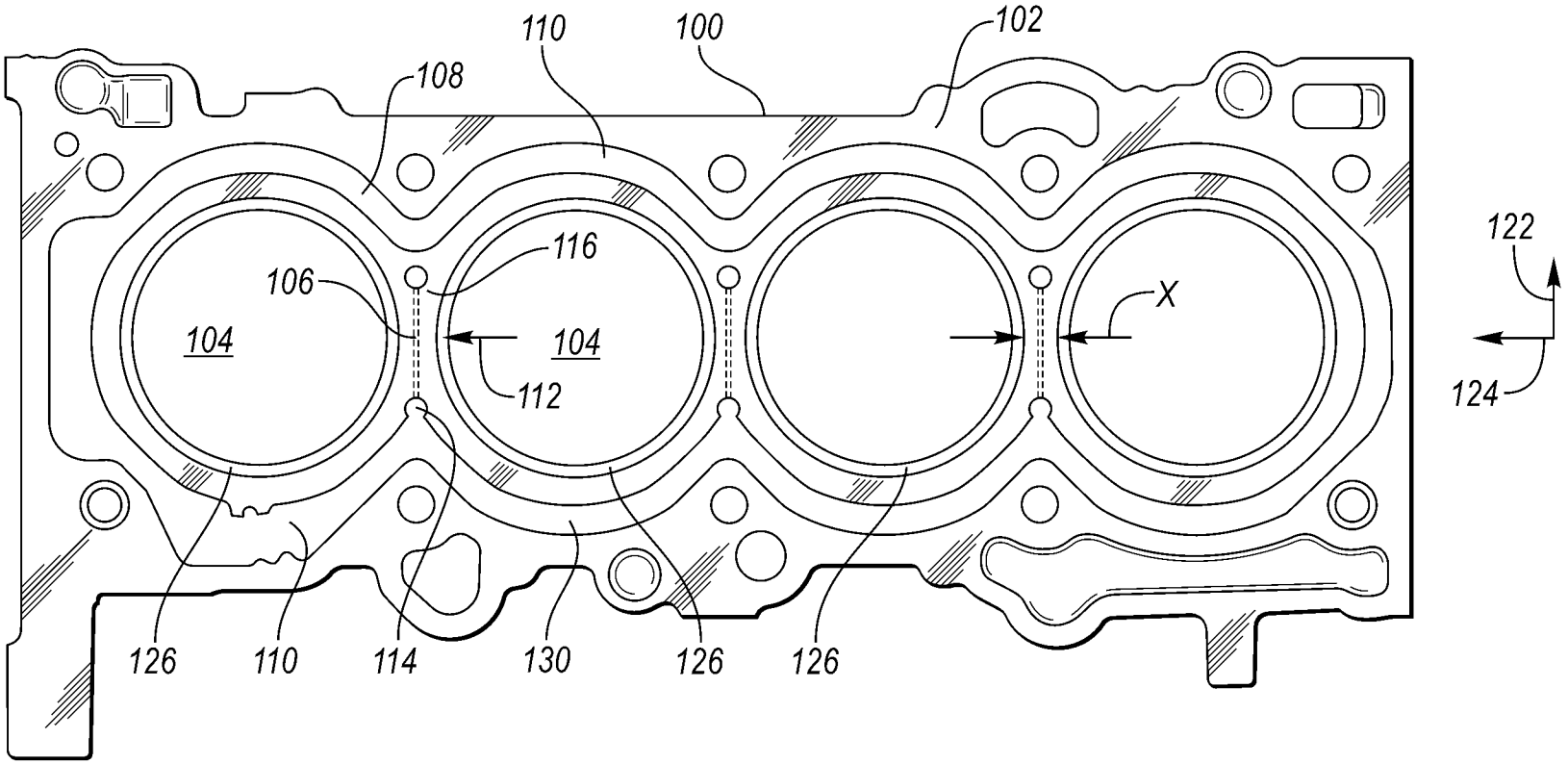
FIG. 3 illustrates a perspective view of a deck face of a cylinder block according to an embodiment.

FIGS. 2-3 illustrate an example of the present disclosure. FIG. 2 illustrates a sectional view of an engine block across a bore bridge according an example of the present disclosure. FIG. 3 illustrates a perspective view of the deck face of the cylinder block.

The cooling system of FIGS. 2-3 may be implemented on the engine illustrated in FIG. 1. FIG. 2 illustrates cooling paths across the cylinder block bore bridge. In other embodiments, a similar cooling path may be provided in the cylinder head bridge. The cylinder block 100 of the engine is connected to a cylinder head using a head gasket to form a combustion chamber in the engine. The cylinder block 100 has a deck face 102 adapted to contact a head gasket.

Between adjacent cylinders 104 in the block 100 are bore bridges 106. The cylinders 104 cooperate with the head to form combustion chambers for the engine.

Coolant in the block cooling jacket 108 flows in a portion 110 of the jacket surrounding each cylinder. The coolant may flow from a passage 110 on the intake side into coolant passages 112 in the bore bridge to a passage on the exhaust side of the block and/or to a cooling jacket in the cylinder head. In the embodiment shown, the coolant flows from passage 110, through the bore bridge passages 112, and to the cylinder head jacket. In other embodiments, the coolant may flow in the other direction from the intake side to the exhaust side, or from the head to the block.

The bridge passages 112 include multiple passages or sections. Passage 114 may be connected to and in fluid communication with the portion 110 of the jacket. In alternative embodiments, passage 116 and/or passage 114 are directly connected to the portion 110 of the jacket. In the example shown, passage 116 is spaced apart from the portion 110 of the jacket, such that passage 116 receives fluid from passage 114 and provides fluid to a head jacket without being in direct fluid communication with the portion 110 of the cylinder jacket.

Passage 116 is connected to passage 114 by at least one transverse passage. In the example shown, passage 118 and passage 120 connect the passages 114, 116. Passage 118 and 120 may extend along a transverse axis 122 of the engine block such that they are generally perpendicular to the longitudinal axis 124 of the engine.

The passages 114, 116 may be generally parallel with one another, and/or may generally extend along an axis parallel with the cylinder axis, or perpendicularly to the engine longitudinal and transverse axes, i.e. a third orthogonal axis 127. In other examples, the passages 114, 116 may be at an angle with the third orthogonal axis. In other examples, one of the passages 114, 116 may be along the axis 127, and the other may be oriented at an angle with the axis 127.

Passages 118, 120 may be general parallel with one another and with the transverse axis 122, or in alternative embodiments, may be oriented at an angle to one another or to the axis 122. In other examples, more than two passages may be provided to provide cooling across the bore bridge in the transverse direction.

Passages 118 and 120 may have the same dimensions or have differing dimensions. The passages 118, 120 may be linear, curved, or otherwise shaped. The passages 118, 120 may have a constant cross sectional area across the bore bridge, or may have increasing or decreasing areas across the bore bridge. The longitudinal dimension of each passage 118, 120 is limited by the dimensions of the bore bridge 106. The bore bridge 106 may be approximately 4-5 mm across to extend between adjacent cylinder liners 126. The passages 118, 120 in the bore bridge 106 need to maintain integrity within each passage to retain engine coolant. If one of the passages 118, 120 lacks integrity such that coolant may be in contact with the cylinder liner 126, coolant and oil in the engine 20 may be able to mix, leading to potential issues with engine operation. As such, control over the precision and accuracy of sizing and positioning of the cooling passages in the narrow bore bridge of the engine is necessary.

The present disclosure provides for a system and method to provide an engine with cooling passages that are cast into the bore bridge of the engine, as described herein. The engine block is die cast with aluminum in a high pressure casting process. The high pressure casting process injects molten aluminum or an alloy at 20,000 psi, for example. In other examples, the molten metal may be provided at other high pressures.

Previously, bore bridge cooling passages have been provided by machining the bore bridge of the engine, for example, by drilling or cross drilling one or more passages, by machining a saw cut, and the like. In another example of conventional processes, a bore bridge cooling passage may be provided using a lost core for low pressure casting. However, in a high pressure casting process, a lost core may be destroyed, providing for unpredictable casting results. In yet another example of a conventional process, a cylindrical tube containing a salt core may be provided; however, the resulting passage geometry is limited.

Figure 4:
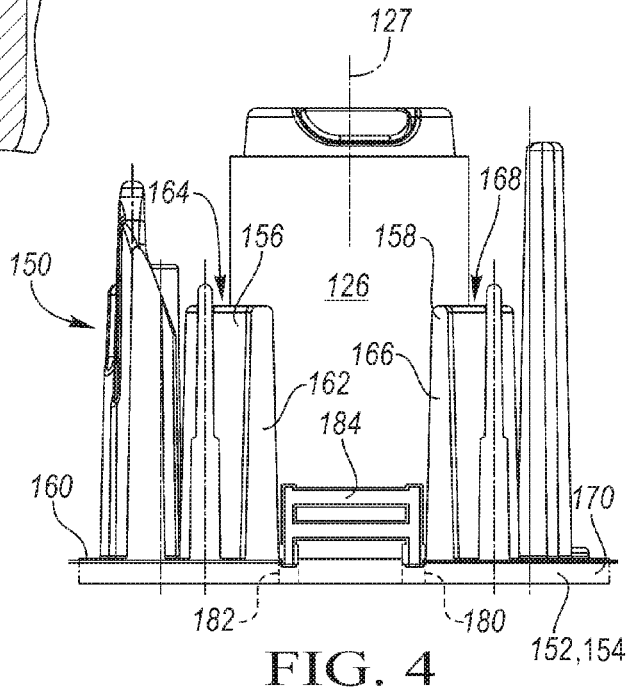
FIG. 4 illustrates a partial view of a die and an insert of a tool for forming the engine block of FIG. 2 according to an embodiment.

FIG. 4 illustrates an example of a tool having an insert core for use with a die to provide a bore bridge cooling passage according to an embodiment of the disclosure. In alternative embodiments, an insert core similar to that described with respect to FIG. 4 may be used to provide for other cooling passages with complex geometry and small dimensions, or for other passages, such as oil gallery passages.

A tool 150 is illustrated for use with a mold for a die casting process in FIG. 4. The tool 150 includes a die 152. In one example, the die 152 may be a slide that cooperates with additional slides when die casting an engine component such as an engine block. The die 152 may form a portion of the engine block, for example, the region surrounding one cylinder, and may cooperate with adjacent, similar dies to form adjacent cylinders. The die 152 may be formed from tool steel or another suitable material for repetitive use in die casting to provide the engine component.

The die 152 has a support member 154 providing a base for various cores and for forming mold cavities. The support member 154 supports a first mold core 156 and a second mold core 158 extending outwardly from a surface 160. The first and second mold cores 156, 158 may be adapted to form a portion of a cylinder cooling jacket. In the example shown, cores 156, 158 are curved protrusions with each sized to form a region, such as region 110, of the cooling jacket surrounding a cylinder. The support member 154 has a cylinder recess sized to receive a cylinder liner 126. The cylinder liner 126 may be made from a ferrous alloy or another material selected for use with the piston for reduced wear. The die casting process for the engine block may include casting the aluminum block directly about the liner 126, as shown.

Core 156 has a first edge 162 and a second edge 164. Core 158 has a first edge 166 and a second edge 168. The first edges 162, 166 are spaced apart from one another and define a region therebetween to form a bore bridge. The second edges 164, 168 are spaced apart from one another and define a region therebetween to form another bore bridge on the other side of the cylinder liner. The first edges 162, 166 of the cores along with an edge of the support member form a mating surface 170. Mating surface 170 cooperates with another mating surface formed by the second edges and an edge of a support member of another adjacent die.

The support member 154 defines a first locator recess 180 and a second locator recess 182 positioned between the first and second cores 156, 158 and adjacent to the mating surface 170.

Figure 5:
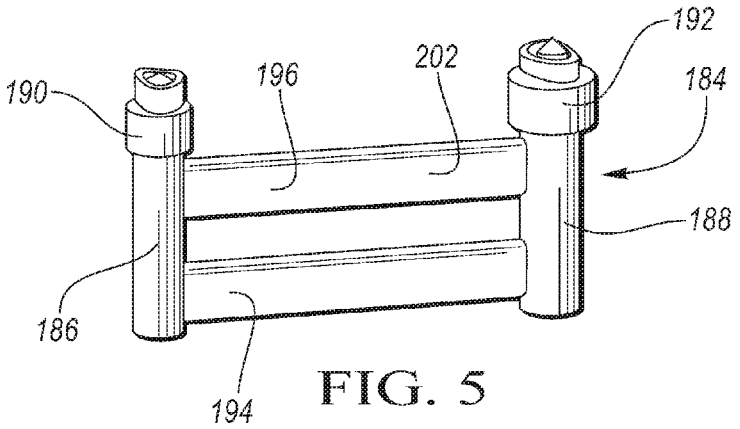
FIG. 5 illustrates a perspective view of the insert of FIG. 4.

An insert core 184, or insert, is provided and has a complex geometry. The insert 184 is adapted to provide bore bridge cooling passages, such as passages 112, in the block. In one example, the insert core 184 is a lost core generally encapsulated by a cast shell. The insert core is shown in detail in FIG. 5. The insert core 184 has a first post 186 and a second post 188 spaced apart from the first post. The first post 186 has a first end region and a second, opposed end region. The second end region of the first post 186 defines a first locator protrusion 190 or locator feature. The protrusion 190 is sized to be received within the first locator recess 180 in the die 152. The second post 188 has a first end region and a second, opposed end region. The second end region of the second post 188 defines a second locator protrusion 192 or locator feature. The protrusion 192 is sized to be received within the second locator recess 182 in the die 152.

The first and second posts 186, 188 may be generally parallel to one another, or may be positioned at an angle relative to one another. The posts 186, 188 may be generally cylindrical or another volumetric shape. The protrusions 190, 192 may have a larger diameter than their respective post 186, 188.

The insert 184 also has a first rail 194 and a second rail 196. The first rail 194 extends from the first end region of the first post 186 to the first end region of the second post 188. The second rail 196 extends from an intermediate region of the first post 186 to an intermediate region of the second post 188. The first and second rails 194, 196 may be generally parallel to one another, or may be positioned at an angle relative to one another. The rails 194, 196 may be generally perpendicular to the posts 186, 188, or may be at an angle to the posts 186, 188 and/or relative to one another. The rail 194 and/or rail 196 may have a circular cross section, or a cross section of another shape, for example, elliptical, quadrilateral, rectangular with rounded edges, etc. The rail 194 and rail 196 may be the same shape or different shapes, and may be the same size or different sizes. Additionally, although the rails 194, 196 are shown as extending along a linear path between the posts 186, 188, they may also extend along a curved or non-linear path.

The size of the first and second rail 194, 196 is limited by the dimensions of the bore bridge. In one example, with a bore bridge of approximately 4-5 mm, the rails 194, 196 must each have a size or width dimension that is less than the bore bridge, or less than approximately 4.5 mm. The limiting dimension, x, of the bore bridge is illustrated in FIG. 3.

Each rail 194, 196 may be positioned based on a need for cooling in the block. For example, a rail may be positioned where the liner is known to have a high temperature during engine operation to lower liner stress. By lowering liner stress, various additional materials may be used for the liner, and/or the engine may be operated at a higher power outlet. Additionally, a rail may be positioned close to the deck face for more even loading of the head gasket joint. In other embodiments, more than two rails are provided, or only one rail may be provided.

To form the engine component, such as an engine block, a plurality of dies 152 or slides are provided and assembled to form the tool to die cast the component. In one example, six slides or dies are provided, although any number of dies may be used based on the tool design.

An insert 184 is formed before use with the tool to die cast the component. The insert 184 includes a lost core center 200, which is illustrated in the sectional view of FIG. 6, explained in further detail below. A shell 202 surrounds or encapsulates the lost core center 200. The lost core center may be a salt core, a sand core, a glass core, a foam core, or another lost core material. The core center 200 is provided generally in the desired shape and size of a portion of the passage 112 or substantially all of the passage 112.

To form the insert, the lost core 200 is formed in the desired shape and size. The shell 202 is then provided around the core 200. In one example, a die casting or casting process is used to form the shell 202 while maintaining the integrity of the core 200. A die, mold, or tool may be provided with the shape of the insert 184. The core 200 is positioned within the die, and the shell 202 is cast or otherwise formed around the core 200. The shell 202 may be formed by a low pressure casting process by injecting molten metal or another material into the mold. The molten metal may be injected at a low pressure between 2-10 psi, 2-5 psi, using a gravity feed, or another similar low pressure range. The material used to form the shell 202 may be the same metal or metal alloy as used to die cast the engine component. By providing the molten metal at a low pressure, the lost core 200 is retained within the shell 202. After the shell 202 cools, the insert 184 is ejected from the tool and is ready for use with the die 152.

The formed insert 184 is positioned with each locator protrusion received within a respective locator recess on the die 152. The insert 184 is coupled to the die using a retaining mechanism. In one example, the retaining mechanism includes a locating pin(s) driven by a solenoid to hold the insert 184 in place by cooperating with one or both of the locating protrusions 190, 192 in the respective recesses 180, 182. The die 152 may include drilled access ports for the pins into one or both recesses 180, 182.

After the insert 184 is positioned on the die 152 as shown in FIG. 4, the tool 150 is closed, and the engine component is die cast by injecting molten metal into the tool 150. The die 152 may be a cover die or an ejector die, that cooperates with the other component to form a mold cavity to form the engine component. The molten metal may be aluminum, an aluminum alloy, or another suitable material. The molten metal is injected at a high pressure, i.e. 20,000 psi, to form the engine component. The molten metal may be injected at a pressure greater than or less than 20,000 psi, for example, in the range of 15000-30000 psi, and may be based on the metal or metal alloy in use, the shape of the mold cavity, and other considerations.

The molten metal flows around the insert 184, and forms a casting skin around the insert. The shell 202 of the insert may be partially melted to meld with the injected metal. The casting skin and shell form the walls of the passage 112 in the bore bridge. Without the shell 202, the injected molten metal would disintegrate the lost core 200. By providing the shell 202, the lost core remains intact for later processing to form the passages 112 in the bore bridge.

Figure 6:
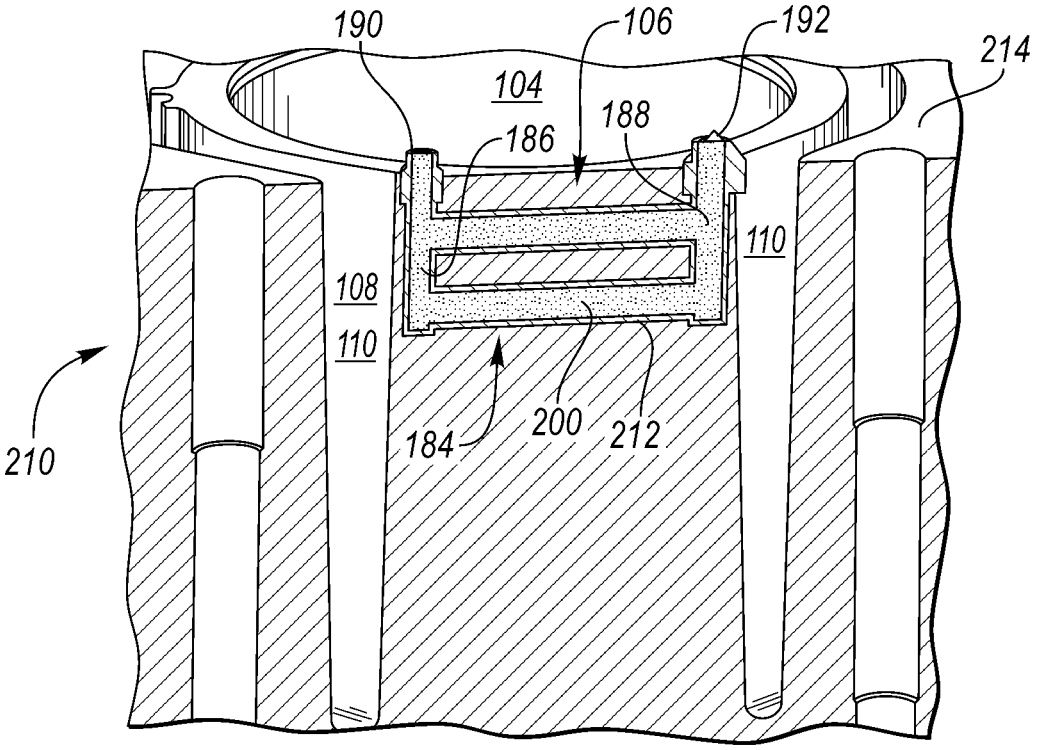
FIG. 6 illustrates a partial sectional view of the engine block of FIG. 2 after removal from the tool and before post casting finishing.

The molten metal cools in the tool 150 to form the engine component, such as an engine block. The injected metal abuts the cylinder liner 126, and forms an engine cooling jacket having cooling passages as defined by the cores 156, 158 and other features of the die 152. The engine component is then removed from the tool 150 and results in an unfinished component 210 as shown in FIG. 6. FIG. 6 is a sectional view taken transversely across a bore bridge 106.

As can be seen in FIG. 6, the cooling jacket 108 has been partially formed using the cores 156, 158 and other fixed cores of the die 152 and the tool 150. The insert 184 remains in the unfinished component 210 after removal from the tool 150. The casting skin 212 is shown in FIG. 6 surrounding the lost core 200. The casting skin 212 may contain at least a portion of the shell 202. As can be seen in FIG. 6, the lost core extends through the posts and the rails of the insert.

The face 214 of the component 210 is machined to form the deck face 102 of the block 100, for example, by milling. The machining process removes an end of each of the locator features 190, 192 of the insert 184. After machining, the lost core 200 is exposed at the intersection of the deck face 102.

The lost core 200 is then removed from the component 210 to form the passages 112. The lost core 200 may be removed using pressurized fluid, such as a high pressure water jet. In other examples, the lost core 200 may be removed using other techniques as are known in the art. The lost core 200 is called a lost core in the present disclosure based on the ability to remove the core in a post die casting process. The lost core in the present disclosure remains intact during the die casting process due to the shell surrounding it.

The bore bridge passages may be provided by additional finishing or machining after die casting in some embodiments. For example, one of the passages, such as passage 114 may be drilled or otherwise machined to connect the passage formed by the post section of the lost core 200 with the cooling jacket 108, as shown in FIG. 2.

Note that a portion of the cooling jacket of the engine block is formed using fixed cores in the die 152, and that another portion of the cooling jacket is formed using the insert and the lost core to provide the bore bridge cooling passage with a narrow cooling passage, and a thin wall separating the bore bridge cooling passages from the cylinder inserts to maintain the integrity of the cooling system and prevent coolant and lubricating fluid mixing.

Figure 7:
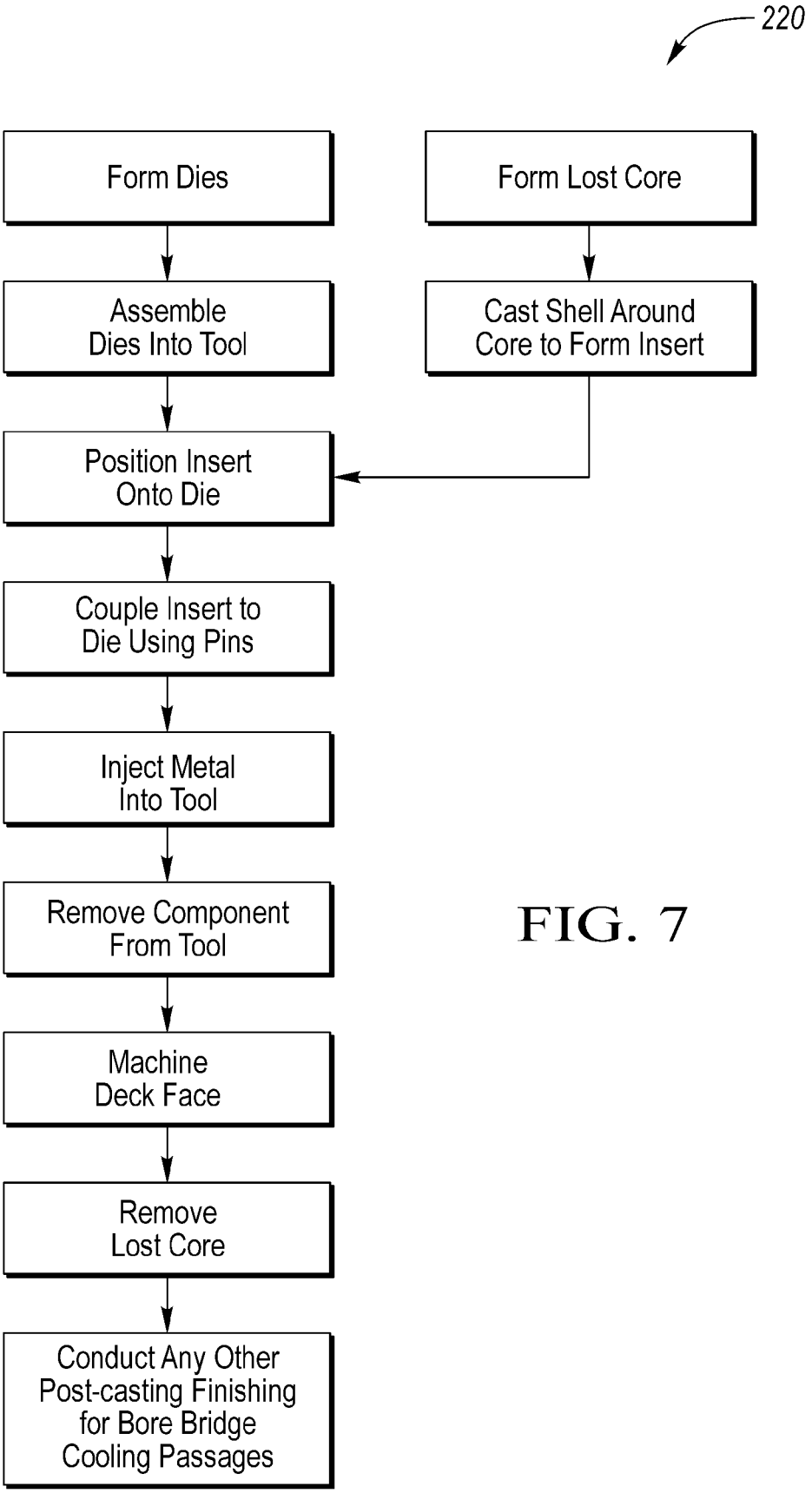
FIG. 7 illustrates a method of forming the engine block of FIG. 2 according to an embodiment.

A flow chart is illustrated in FIG. 7 showing a method 220 for forming the engine component as described above.

Various embodiments of the present disclosure have associated, non-limiting advantages. For example, die cast blocks with narrow bridges may be difficult to cool, and/or the liner and gasket joint may be insufficiently cooled, especially for small bore, high output engines, such as aluminum block engines. The engine block is die cast using a lost core that is loaded into a die slide. When the die slide and the lost core are removed, bore bridge cooling passage(s) are provided in the bore bridge. These passages may be formed in a variety of cross-sectional geometries based on the cooling requirements.

While exemplary embodiments are described above, it is not intended that these embodiments describe all possible forms of the invention. Rather, the words used in the specification are words of description rather than limitation, and it is understood that various changes may be made without departing from the spirit and scope of the disclosure. Additionally, the features of various implementing embodiments may be combined to form further embodiments.

What is claimed is:

1. A tool for forming an engine component comprising:

a die having a support member defining first and second locator recesses positioned between first and second cores adapted to form a cylinder cooling jacket; and an insert having a lost core center generally encapsulated by a die cast aluminum shell, the insert having first and second locator protrusions sized to be received by the first and second locator recesses respectively, the insert adapted to form a cooling passage for a bore bridge of the engine component between adjacent cylinders;

wherein the insert has a first post and a second post spaced apart from the first post, a first rail extending from an end of the first post to an end of the second post, and a second rail extending from an intermediate region of the first post to an intermediate region of the second post, wherein the first locator protrusion extends from another end of the first post, and the second locator protrusion extends from another end of the second post, wherein a diameter of each locator protrusion is greater than a diameter of an associated post.

2. The tool according to claim 1 wherein the die is a first die defining a first mating surface adjacent to the first and second locator recesses; the tool further comprising:

a second die having a second support member defining third and fourth locator recesses positioned between third and fourth cores adapted to form the cylinder cooling jacket, the second die having a second mating surface adjacent to the third and fourth locator recesses and a third mating surface spaced apart from the second mating surface and adapted to cooperate with the first mating surface to form the tool; and a second insert having a second lost core center generally encapsulated by a second die cast aluminum shell, the second insert having third and fourth locator protrusions sized to be received by the third and fourth locator recesses respectively, the second insert adapted to form a second cooling passage for a second bore bridge of the engine component between adjacent cylinders.

3. The tool according to claim 1 wherein the first and second rails are generally parallel to one another; and wherein the first and second rails are generally perpendicular to the first and second posts.

4. The tool according to claim 1 wherein the first and second rail each have a width of less than 4.5 mm.

5. An engine component formed using the tool according to claim 1 wherein the engine component comprises a member defining a first cylinder and a second cylinder spaced apart along a longitudinal axis of the engine component by a bore bridge, the bore bridge having a first cooling passage extending transversely and spaced apart from a deck face of the member, the bore bridge having a second cooling passage extending transversely and positioned between the first cooling passage and the deck face, wherein the first and second cooling passages are formed by a casting skin.

6. A method of forming an engine component, the method comprising:

providing a die defining a locator recess and at least one core;

die casting a metal shell around a lost core center to form an insert;

positioning the insert into the recess on the die; and die casting the component with the die and the insert to form a fluid jacket with a casting skin about the insert for a fluid passage.

7. The method of claim 6 wherein die casting the component comprises injecting molten metal at a pressure of at least 20000 psi, wherein the molten metal comprises aluminum.

8. The method of claim 6 wherein die casting the metal shell comprises die casting by injecting molten metal at a pressure of less than 10 psi, the molten metal comprising aluminum; and wherein the insert is formed prior to being positioned on the die.

9. The method of claim 6 wherein forming the insert further comprises forming the insert with a first post, a second post, and a rail extending therebetween;

wherein the first post, the second post, and the rail each contain a portion of the lost core; and wherein the first post has a locator protrusion sized to be received within the locator recess, a diameter of the locator protrusion being greater than a diameter of the first post.

10. The method of claim 9 further comprising machining the component after die casting to remove the locator protrusion of the first post and form a deck face of the engine component.

11. The method of claim 6 further comprising removing the lost core center from the metal shell to provide the fluid passage after die casting the component.

12. The method of claim 6 further comprising retaining the insert in the die during die casting using pins connected to a solenoid.

13. The method of claim 6 further comprising forming the at least one core of the die with a first curved core and a second curved core extending away from a support member, the first and second curved cores adapted to form a portion of the fluid jacket about a cylinder liner, each curved core having a first edge and a second opposed edge, the first edge of the first core and the first edge of the second core spaced apart from one another and adapted to form a bore bridge between adjacent cylinder liners, wherein the fluid passage is a bore bridge cooling passage.

14. The method of claim 13 further comprising inserting the cylinder liner between the first and second curved cores before die casting the component;

wherein an outer surface of the cylinder liner is directly adjacent to the insert.

15. A component comprising:

a block defining a bore bridge separating adjacent cylinders, the bore bridge defining a cooling passage having first and second transverse passages fluidly connecting third and fourth passages intersecting a deck face, the second passage positioned between the first passage and the deck face, only the third passage intersecting a cylinder cooling jacket, the fourth passage intersecting only the first and second passages, the cooling passage formed by a casting skin.

16. The component according to claim 15 wherein the third passage is positioned on one side of the bore bridge, and the fourth passage is positioned on another side of the bore bridge.

17. The method of claim 6 wherein the insert is formed with a post having an end region forming a locator protrusion sized to be received within the locator recess, a diameter of the locator protrusion being greater than a diameter of the post.

* * * * *